US006053016A

United States Patent [19]

Young

[11] Patent Number: 6,053,016

[45] Date of Patent: Apr. 25, 2000

[54] WIRING SECURITY DEVICE

[76] Inventor: Robert C. Young, 541 W. Crestline Cir., Littleton, Colo. 80120

[21] Appl. No.: 09/015,082

[22] Filed: Jan. 29, 1998

[51] Int. Cl.[7] ..... E05B 65/00

[52] U.S. Cl. ..... 70/57; 70/58; 70/159

[58] Field of Search ..... 292/1, 281, 282, 292/284, 286, 287; 70/1, 57, 58, 18, 14, 159, 160, 161, 164, 165, 178, 203; 439/133

[56] References Cited

U.S. PATENT DOCUMENTS

| | | | |
|---|---|---|---|
| 1,168,066 | 1/1916 | Girardot | 292/281 |
| 1,292,486 | 1/1919 | Kumler | 70/18 |
| 1,427,285 | 8/1922 | Goehner | 70/203 |
| 1,805,401 | 5/1931 | Janney | 292/281 |
| 1,831,513 | 11/1931 | Sitz et al. | 70/18 |
| 2,716,882 | 9/1955 | Gill et al. | 70/57 |
| 2,931,676 | 4/1960 | Wroughton | 292/282 |
| 4,170,334 | 10/1979 | Villanueva | 70/58 |
| 4,750,898 | 6/1988 | Soulard | 439/133 |
| 5,348,495 | 9/1994 | Kasden | 439/371 |
| 5,398,530 | 3/1995 | Derman | 70/58 |
| 5,468,925 | 11/1995 | Mohsen | 70/203 |
| 5,746,074 | 5/1998 | Collins | 70/14 |
| 5,816,081 | 10/1998 | Johnston | 70/58 |

*Primary Examiner*—Darnell M. Boucher

[57] ABSTRACT

An anti-theft device is provided including an electrical appliance having a power cord. A stationary hinge portion is fixedly coupled to a recipient surface. Associated therewith is a movable hinge portion hingably coupled to the stationary hinge portion and further lockable with respect thereto. A cord may then be situated between the hinge portions and locked therebetween for preventing the theft of the electrical appliance.

9 Claims, 3 Drawing Sheets

WIRING SECURITY DEVICE

BACKGROUND OF THE INVENTION

1. Field of the Invention

The present invention relates to power cord securement mechanisms and more particularly pertains to a new wiring security device for preventing the theft of an electric appliance.

2. Description of the Prior Art

The use of power cord securement mechanisms is known in the prior art. More specifically, power cord securement mechanisms heretofore devised and utilized are known to consist basically of familiar, expected and obvious structural configurations, notwithstanding the myriad of designs encompassed by the crowded prior art which have been developed for the fulfillment of countless objectives and requirements.

Known prior art power cord securement mechanisms include U.S. Pat. No. 5,398,530; U.S. Pat. No. 5,338,212; U.S. Pat. No. 5,190,466; U.S. Pat. No. 4,768,974; U.S. Pat. No. 4,653,824; and U.S. Pat. No. 4,674,813.

In these respects, the wiring security device according to the present invention substantially departs from the conventional concepts and designs of the prior art, and in so doing provides an apparatus primarily developed for the purpose of preventing the theft of an electric appliance.

SUMMARY OF THE INVENTION

In view of the foregoing disadvantages inherent in the known types of power cord securement mechanisms now present in the prior art, the present invention provides a new wiring security device construction wherein the same can be utilized for preventing the theft of an electric appliance.

The general purpose of the present invention, which will be described subsequently in greater detail, is to provide a new wiring security device apparatus and method which has many of the advantages of the power cord securement mechanisms mentioned heretofore and many novel features that result in a new wiring security device which is not anticipated, rendered obvious, suggested, or even implied by any of the prior art power cord securement mechanisms, either alone or in any combination thereof.

To attain this, the present invention generally comprises a stationary hinge portion having a metallic plate with a planar square configuration. Such plate is equipped with a front face, a rear face and a periphery formed therebetween defined by a top edge, a bottom edge, a first side edge and a second side edge. Further, the plate of the stationary hinge portion has a circular aperture formed adjacent each of the corners thereof, as shown in FIG. 2. A pair of spaced tubes are integrally coupled along the first side edge thereof with elongated bores which remain in coaxial alignment. Also, a locking bracket is provided including a first planar extent coupled to the front face of the plate adjacent to the second side edge thereof. The locking bracket further has a second planar extent integrally coupled to the first planar extent and extended outwardly therefrom in general coplanar relationship with the second side edge of the plate of the stationary hinge portion. For reasons that will become apparent, the second planar extent has an aperture formed therein. During use, the stationary hinge portion is screwably coupled flush against a planar recipient surface above an alternating current receptacle. Next provided is a movable hinge portion including a metallic plate having a square configuration. The movable hinge portion, as a whole, defines a portion of a vertically oriented hollow cylinder. In other words, the movable hinge portion is equipped with a front face, a rear face and a periphery formed therebetween defined by an arcuate top edge, an arcuate bottom edge, a linear first side edge and a linear second side edge. The plate of the movable hinge portion has a pair of spaced tubes integrally coupled along the first side edge thereof each with an elongated bore. Such bores remain in coaxial alignment, as shown in FIG. 2. In operation, the tubes of the movable hinge portion are aligned with those of the stationary hinge portion and a pin is situated through the bores thereof for allowing the pivoting of the movable hinge portion with respect to the stationary hinge portion between an open and a closed orientation. Note FIG. 3. A locking bracket includes a first planar extent coupled to the rear face of the plate of the movable hinge portion adjacent to the second side edge thereof. Associated therewith is a second planar extent integrally coupled to the first planar extent and extended outwardly therefrom in general coplanar relationship with the second side edge of the plate of the movable hinge portion. Similar to the locking bracket of the stationary hinge portion, the second planar extent of the present locking bracket has an aperture formed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wiring security device apparatus and method which has many of the advantages of the power cord securement mechanisms mentioned heretofore and many novel features that result in a new wiring security device which is not anticipated, rendered obvious, suggested, or even implied by any of the prior art power cord securement mechanisms, either alone or in any combination thereof.

It is another object of the present invention to provide a new wiring security device which may be easily and efficiently manufactured and marketed.

It is a further object of the present invention to provide a new wiring security device which is of a durable and reliable construction.

An even further object of the present invention is to provide a new wiring security device which is susceptible of a low cost of manufacture with regard to both materials and labor, and which accordingly is then susceptible of low prices of sale to the consuming public, thereby making such wiring security device economically available to the buying public.

Still yet another object of the present invention is to provide a new wiring security device which provides in the apparatuses and methods of the prior art some of the advantages thereof, while simultaneously overcoming some of the disadvantages normally associated therewith.

Still another object of the present invention is to provide a new wiring security device for preventing the theft of an electric appliance.

Even still another object of the present invention is to provide a new wiring security device that includes an electrical appliance having a power cord. A stationary hinge portion is fixedly coupled to a recipient surface. Associated therewith is a movable hinge portion hingably coupled to the stationary hinge portion and further lockable with respect thereto. A cord may then be situated between the hinge portions and locked therebetween for preventing the theft of the electrical appliance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
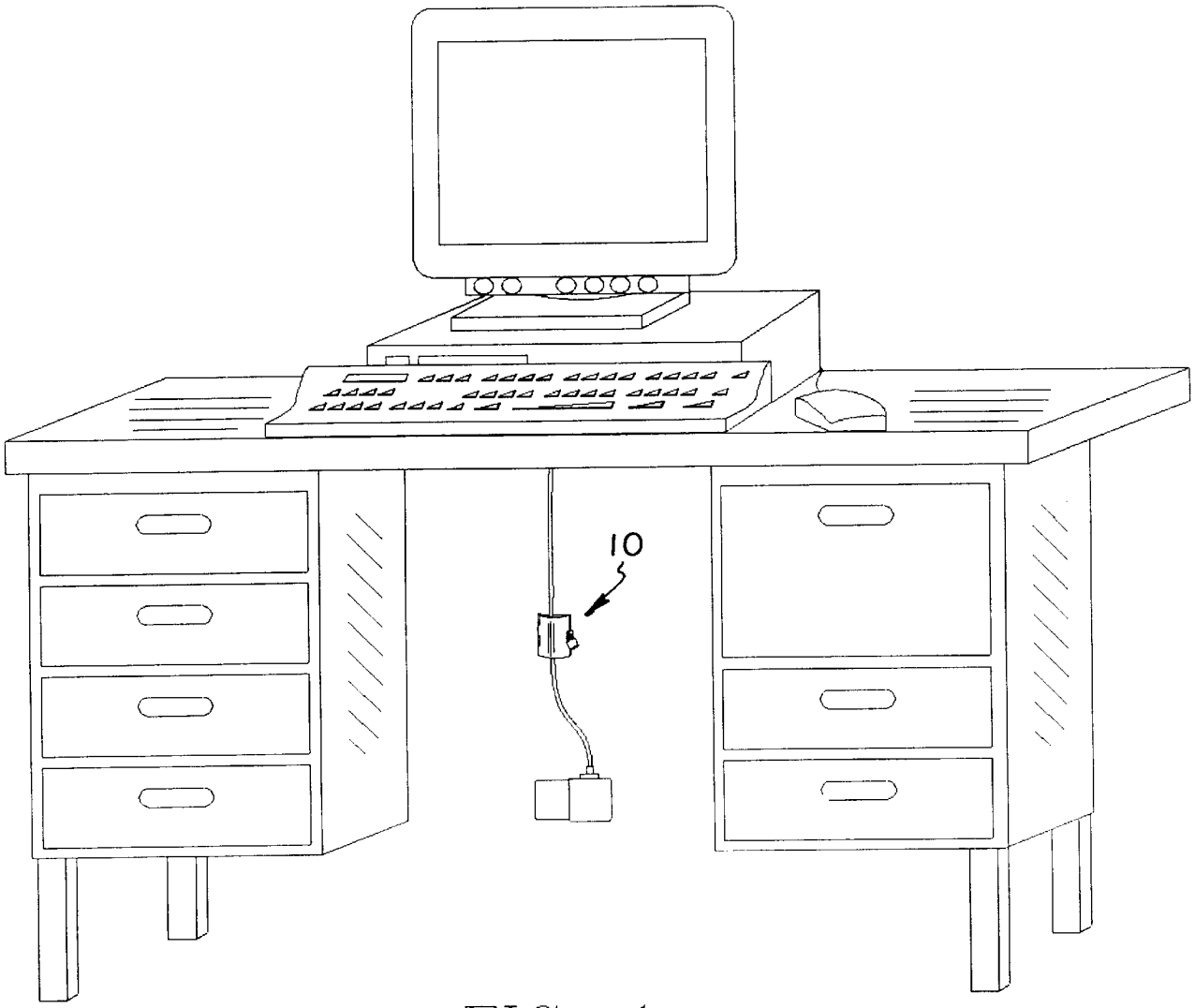
FIG. 1 perspective view of a new wiring security device according to the present invention.
Figure 2:
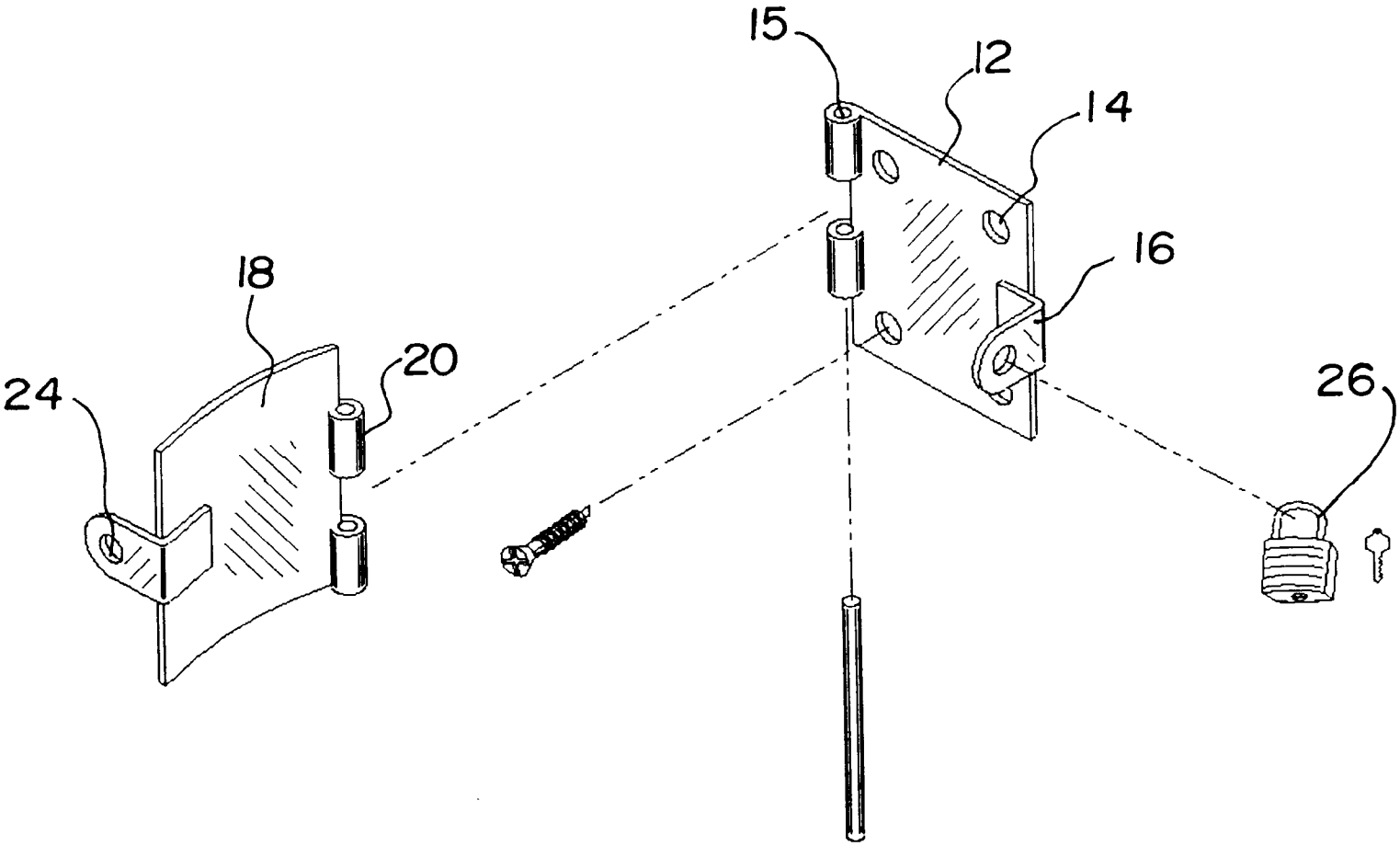
FIG. 2 is an exploded view of the present invention.
Figure 3:
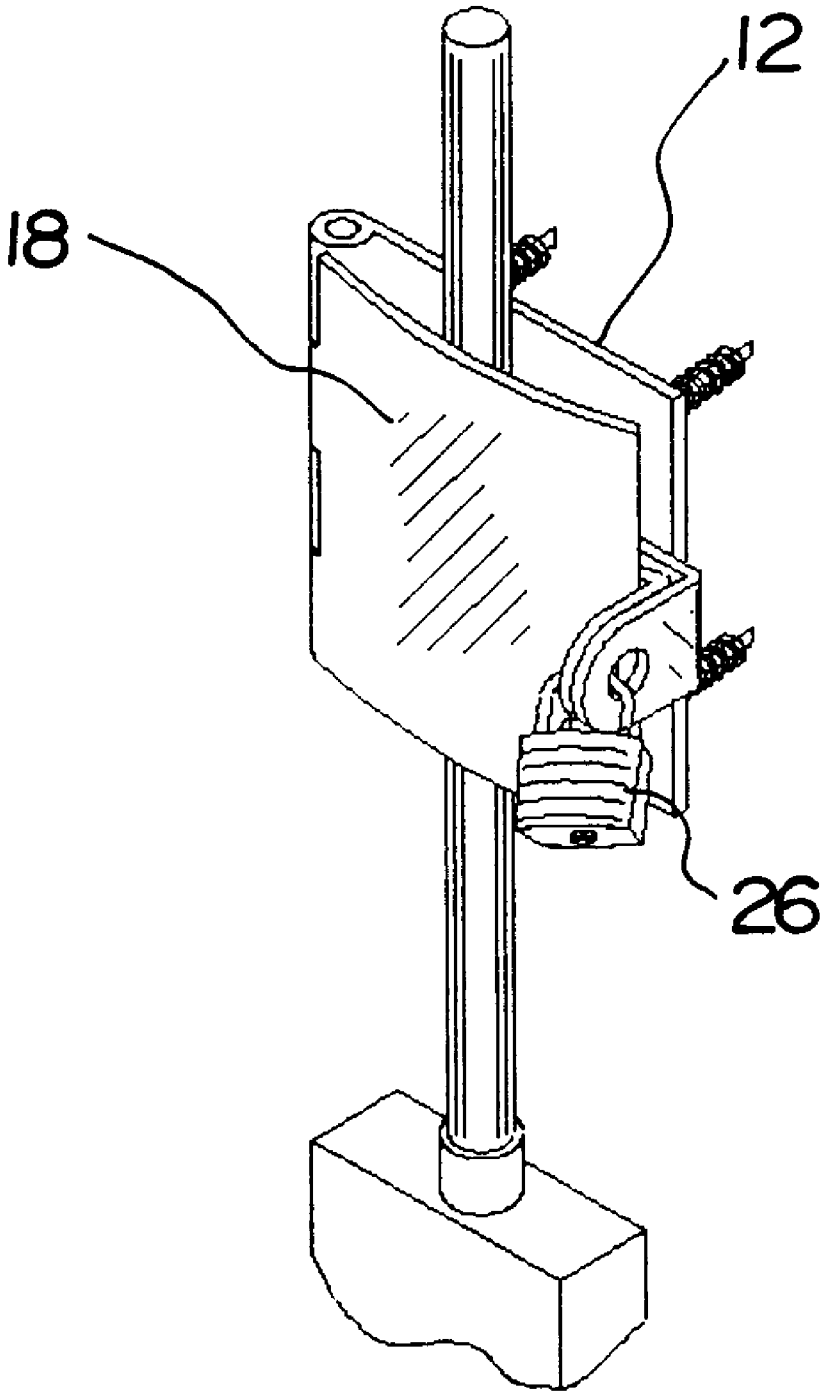
FIG. 3 is a perspective view of the present invention with the movable hinge portion in the closed, locked orientation thereof.

With reference now to the drawings, and in particular to FIGS. 1 through 3 thereof, a new wiring security device embodying the principles and concepts of the present invention and generally designated by the reference numeral 10 will be described.

The present invention, designated as numeral 10, includes a stationary hinge portion 12 having a metallic plate with a planar square configuration. Such plate is equipped with a front face, a rear face and a periphery formed therebetween defined by a top edge, a bottom edge, a first side edge and a second side edge. Further, the plate of the stationary hinge portion has a circular aperture 14 formed adjacent each of the corners thereof, as shown in FIG. 2. A pair of spaced tubes 15 are integrally coupled along the first side edge of the plate with elongated bores which remain in coaxial alignment. The tubes of the stationary hinge portion include a central tube and an upper tube. Ideally, the tubes of the stationary hinge portion preferably reside in front of the front face of the stationary hinge portion.

Also, a locking bracket 16 is provided including a first planar extent coupled to the front face of the plate adjacent to the second side edge thereof. Such coupling may be afforded by way of a rivet or weld. The locking bracket further has a second planar extent with an arcuate periphery and a size similar to that of the first planar extent. The second planar extent is integrally and perpendicularly coupled to the first planar extent and extended outwardly therefrom in general coplanar relationship with the second side edge of the plate of the stationary hinge portion at a central extent thereof. For reasons that will become apparent, the second planar extent has an aperture formed therein. During use, the stationary hinge portion is screwably coupled flush against a planar recipient surface above an alternating current receptacle.

Next provided is a movable hinge portion 18 including a metallic plate having a square configuration. The movable hinge portion, as a whole, defines a portion of a vertically oriented hollow cylinder. In other words, the movable hinge portion is equipped with a smooth front face, a smooth rear face and a periphery formed therebetween. Such periphery is defined by an arcuate top edge, an arcuate bottom edge, a linear first side edge and a linear second side edge. The plate of the movable hinge portion has a pair of spaced tubes 20 integrally coupled along the first side edge thereof each with an elongated bore. Such tubes of the movable hinge portion include a bottom tube and a central tube. The tubes of the movable hinge portion preferably reside to the rear of the rear face. In operation, the tubes of the movable hinge portion are aligned with those of the stationary hinge portion and a pin is situated through the bores thereof for allowing the pivoting of the movable hinge portion with respect to the stationary hinge portion between an open and a closed orientation. Note FIG. 3. A locking bracket 24 of the movable hinge portion includes a first planar extent with an arcuate periphery. The first planar extent is coupled to the rear face of the plate of the movable hinge portion adjacent to the second side edge thereof. Associated therewith is a second planar extent integrally and perpendicularly coupled to the first planar extent and extended outwardly therefrom in general coplanar relationship with the second side edge of the plate of the movable hinge portion at a central extent thereof. Similar to the locking bracket of the stationary hinge portion, the second planar extent of the present locking bracket has an aperture formed therein.

During use, a cord associated with the computer may be situated between the hinge portions. When the movable hinge portion is in the closed orientation, the cord is clamped in place and the apertures of the locking brackets are aligned such that a padlock 26 may be secured therein for preventing the theft of the appliance.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A computer with anti-theft device comprising, in combination:

a computer having a cord extending therefrom; and an anti-theft device, comprising:

a stationary hinge portion including a metallic plate having a planar square configuration with a front face, a rear face and a periphery formed therebetween defined by a top edge, a bottom edge, a first side edge and a second side edge, the plate of the stationary hinge portion having a circular aperture formed adjacent each of the corners thereof, a pair of spaced tubes integrally coupled along the first side edge thereof with elongated bores which remain in coaxial alignment, and a locking bracket including a first planar extent coupled to the front face of the plate adjacent to the second side edge thereof and a second planar extent integrally coupled to the first planar extent and extending outwardly therefrom in general coplanar relationship with the second side edge of the plate of the stationary hinge portion and having an aperture formed therein, wherein the stationary hinge portion is adapted to be screwably coupled flush against a planar recipient surface above an alternating current receptacle; and a movable hinge portion including a metallic plate having a square configuration which, as a whole, defines a portion of a hollow cylinder, the movable hinge portion equipped with a front face, a rear face and a periphery formed therebetween defined by an arcuate top edge, an arcuate bottom edge, a linear first side edge and a linear second side edge, the plate of the movable hinge portion having a pair of spaced tubes integrally coupled along the first side edge thereof each with an elongated bore which remain in coaxial alignment wherein the tubes of the movable hinge portion are aligned with those of the stationary hinge portion and a pin is situated through the bores thereof for allowing the pivoting of the movable hinge portion with respect to the stationary hinge portion between an open and a closed orientation, and a locking bracket including a first planar extent coupled to the rear face of the plate of the movable hinge portion adjacent to the second side edge thereof and a second planar extent integrally coupled to the first planar extent and extending outwardly therefrom in general coplanar relationship with the second side edge of the plate of the movable hinge portion and having an aperture formed therein, the cord of the computer being situated between the hinge portions, wherein when the movable hinge portion is in the closed orientation, the apertures of the locking brackets are aligned such that the padlock may be secured therein for preventing the theft of the computer;

wherein a distance between the first side edge of the stationary hinge portion and the first side edge of the movable hinge portion is less than an outer diameter of the power cord for helping keep the cord centrally aligned between the stationary hinge portion and the movable hinge portion;

wherein a distance between the second side edge of the stationary hinge portion and the second side edge of the movable hinge portion is less than the outer diameter of the power cord;

wherein a maximum distance between the top edge of the stationary hinge portion and the arcuate top edge of the movable hinge portion is about equal to the outer diameter of the power cord for preventing sliding of a plug of the cord between the stationary hinge portion and the movable hinge portion;

wherein a maximum distance between the bottom edge of the stationary hinge portion and the arcuate bottom edge of the movable hinge portion is about equal to the outer diameter of the power cord for preventing sliding of the plug of the cord between the stationary hinge portion and the movable hinge portion.

2. An appliance with an anti-theft device comprising, in combination:

an electrical appliance having a power cord;

a stationary hinge portion having mounting apertures adapted to fixedly couple the anti-theft device to a recipient surface; and a movable hinge portion hingably coupled to the stationary hinge portion and further lockable with respect to the stationary hinge portion, the power cord of the appliance being situated between the hinge portions and locked therebetween for preventing the theft of the electrical appliances;

wherein a maximum distance between the stationary hinge portion and the movable hinge portion is about equal to the outer diameter of the power cord for preventing sliding of a plug of the cord between the stationary hinge portion and the movable hinge portion.

3. An anti-theft device as set forth in claim 2 wherein the stationary hinge portion is adapted to be mounted to the recipient surface in a general coplanar relationship therewith.

4. An anti-theft device as set forth in claim 2 wherein the movable hinge portion is defined by a portion of a hollow cylinder.

5. An anti-theft device as set forth in claim 4 wherein the movable hinge portion is equipped with a front face, a rear face and a periphery formed therebetween defined by an arcuate top edge, an arcuate bottom edge, a linear first side edge and a linear second side edge.

6. An anti-theft device as set forth in claim 2 wherein the hingable coupling between the hinge portions including a plurality of spaced tubes with a pin situated therebetween.

7. An anti-theft device as set forth in claim 2 wherein each hinge portion includes a locking bracket including a first planar extent coupled to the corresponding hinge portion and a second planar extent integrally coupled to the first planar extent and extending outwardly therefrom and having an aperture formed therein.

8. An anti-theft device as set forth in claim 5 wherein a distance between the first side edge of the stationary hinge portion and the first side edge of the movable hinge portion is less than an outer diameter of the power cord for helping keep the cord centrally aligned between the stationary hinge portion and the movable hinge portion, wherein a distance between the second side edge of the stationary hinge portion and the second side edge of the movable hinge portion is less than the outer diameter of the power cord.

9. An anti-theft device as set forth in claim 2 wherein the appliance is a computer.

* * * * *